US010365071B2

(12) United States Patent
Peters et al.

(10) Patent No.: US 10,365,071 B2
(45) **Date of Patent: *Jul. 30, 2019**

(54) ANTI-BALLISTIC CHAIRS

(71) Applicant: SHIELDPRO, LLC, Irvine, CA (US)

(72) Inventors: Fred E. Peters, Orange, CA (US); Jens Wemhoener, Aachen (DE)

(73) Assignee: SHIELDPRO, LLC, Orange, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/076,134

(22) Filed: Nov. 8, 2013

(65) Prior Publication Data

US 2014/0060299 A1 Mar. 6, 2014

Related U.S. Application Data

(60) Continuation of application No. 13/341,278, filed on Dec. 30, 2011, now Pat. No. 8,579,367, which is a division of application No. 13/079,551, filed on Apr. 4, 2011, now Pat. No. 8,573,704.

(51) Int. Cl.

| | |
|---|---|
| ***F41H 5/08*** | (2006.01) |
| ***F41H 5/013*** | (2006.01) |
| ***A47C 3/04*** | (2006.01) |
| ***A47C 7/22*** | (2006.01) |
| ***A47C 15/00*** | (2006.01) |

(52) U.S. Cl.

CPC ..... *F41H 5/08* (2013.01); *A47C 3/04* (2013.01); *A47C 7/22* (2013.01); *A47C 15/004* (2013.01); *F41H 5/013* (2013.01); *Y10T 29/49826* (2015.01)

(58) Field of Classification Search

CPC ... F41H 5/013; F41H 5/08; A47C 3/04; A47C 15/004; A47C 15/007; A47C 7/22

USPC ..... 297/452.13, 452.63, 452.64

See application file for complete search history.

(56) References Cited

U.S. PATENT DOCUMENTS

| | | | | |
|---|---|---|---|---|
| 1,959,046 A | | 5/1934 | Welliver | |
| 2,122,935 A | | 7/1938 | Fleischer | |
| 2,146,932 A | | 2/1939 | Boman | |
| 2,532,873 A | | 12/1950 | Abramson et al. | |
| 2,633,901 A | | 4/1953 | Norquist | |
| 2,874,755 A | | 2/1959 | Smith | |
| 3,273,877 A | * | 9/1966 | Geller | B60N 2/72 267/89 |
| 3,695,687 A | | 10/1972 | Uyeda | |
| 4,010,980 A | * | 3/1977 | Dubinsky | A47C 7/22 160/371 |
| 4,865,380 A | * | 9/1989 | Heitzman-Powell | B60N 2/90 297/184.13 |
| 5,063,625 A | * | 11/1991 | Perry | A47C 23/0435 267/89 |
| 5,164,536 A | | 11/1992 | Barbaza | |

(Continued)

FOREIGN PATENT DOCUMENTS

JP 2002181496 A 6/2002

*Primary Examiner* — David R Dunn
*Assistant Examiner* — Tania Abraham
(74) *Attorney, Agent, or Firm* — Procopio, Cory, Hargreaves & Savitch LLP

(57) ABSTRACT

An anti-ballistic chair having a chair frame, a seat member secured to the frame, the seat member having an anti-ballistic core portion, and a back support section secured to the frame, the back support member having an anti-ballistic core portion.

20 Claims, 10 Drawing Sheets

(56) References Cited

U.S. PATENT DOCUMENTS

| | | | | |
|---|---|---|---|---|
| 5,393,126 | A * | 2/1995 | Boulva | A47C 5/06 297/440.11 |
| 5,448,938 | A | 9/1995 | Fernandez et al. | |
| 5,582,463 | A | 12/1996 | Linder et al. | |
| 6,073,884 | A | 6/2000 | Lavergne | |
| 6,179,382 | B1 | 1/2001 | Schwartz | |
| 6,196,632 | B1 | 3/2001 | De Lucchi et al. | |
| 6,286,901 | B1 | 9/2001 | Ritch et al. | |
| 6,382,716 | B1 | 5/2002 | Wu | |
| 6,688,554 | B2 | 2/2004 | Weekly | |
| 6,786,126 | B2 | 9/2004 | Sargent | |
| 7,111,905 | B2 | 9/2006 | Finney | |
| 7,147,286 | B2 | 12/2006 | Cesaroni et al. | |
| 7,148,162 | B2 | 12/2006 | Park et al. | |
| 7,552,975 | B2 | 6/2009 | Maier et al. | |
| 7,588,297 | B1 * | 9/2009 | Picard | A47C 7/282 297/452.56 |
| 7,607,733 | B1 | 10/2009 | Lin et al. | |
| 7,669,935 | B2 | 3/2010 | Crossley et al. | |
| 8,033,609 | B2 * | 10/2011 | Orzelski | B60N 2/80 297/391 |
| 2003/0085607 | A1 * | 5/2003 | Jones | A47C 5/06 297/452.56 |
| 2003/0198766 | A1 | 10/2003 | Ezoe | |

* cited by examiner

ANTI-BALLISTIC CHAIRS

FIELD OF THE INVENTION

This application provides a unique construction of Anti-ballistic Chairs. More particularly, the core of these anti-ballistic chairs will consist of layers of flexible anti-ballistic fabric (soft armor) wrapped in two directions around the tubular members of the back rest, seat and skirt section, and alternatively, the anti-ballistic chairs will be constructed of pre-manufactured hard anti-ballistic armor components (hard armor).

BACKGROUND

Bulletproofing is the process of making something capable of stopping a bullet or similar high velocity projectiles e.g. shrapnel. The term bullet resistance is often preferred because few, if any, practical materials provide complete protection against all types of bullets, or multiple hits in the same location. Bullet designs vary widely, not only according to the particular firearm used (e.g. a 9×19 mm Parabellum caliber hollowpoint handgun cartridge will have inferior penetration power compared to a 7.62×39 mm assault rifle cartridge), but also within individual cartridge designs. As a result, whilst so-called "bullet-proof" panels may successfully prevent penetration by standard 7.62×39 mm bullets containing lead cores, the same panels may easily be defeated by 7.62×39 mm armor piercing bullets containing hardened steel penetrators.

Bullet-resistant materials, also called ballistic materials or, equivalently, anti-ballistic materials, are usually rigid, but may be supple. They may be complex, such as KEVLAR®, LEXAN®, and carbon fiber composite materials, or they may be basic and simple, such as steel or titanium. Bullet resistant materials are often used in law enforcement and military applications, to protect personnel from death or serious injuries.

There is a growing need for methods of self protection in an increasingly wide variety of locations. In the modern world, crimes and attacks committed by persons with guns are an ever more common occurrence. In the past, police personnel and military personnel have been the primary targets of gunfire which has been directed toward them during work or duty. Because of this continual risk of harm, bullet resistant vests and shields have been developed which may be deployed or worn on the user's body as a protective component of their work attire. Such devices, when employed for protection against weapons fire have worked fairly well in preventing a high velocity bullet or shell from penetrating the wearer's body since the velocity is slowed considerably.

It has been made clearly evident by the shooting at Fort Hood that additional means of self protection has become very necessary. The mass shooting took place on Nov. 5, 2009, at Fort Hood, the most populous U.S. military installation in the world, located just outside Killeen, Tex. In the course of the shooting, a single gunman killed 13 people and wounded 29 others. According to witnesses, Army reserve Captain John Gaffaney attempted to stop Hasan, either by charging him or throwing a chair at him, but was mortally wounded in the process. Civilian physician assistant Michael Cahill also tried to charge Hasan with a chair before being shot and killed. Army reserve Specialist Logan Burnette tried to stop Hasan by throwing a folding table at him, but he was shot in the left hip, fell down, and crawled to a nearby cubicle.

It was additionally made evident at Columbine High School in Colorado in 1999 that similar occurrences may again occur at other locations where civilians, including children are affected and there is an increased need for self protection. With the introduction of a ballistic-proof chair, such a device can blend into a conventional room's appearance where people gather such as meeting rooms, classrooms, libraries or cafeterias and it can thereby keep from making a room where people gather for social or educational purposes appear like a military bunker.

With the advent of new materials and the improvement of manufacturing processes, items like ballistic-proof chairs can become a practical item. It is well known that the construction of bullet-proof vests is done by applying multiple layers of fabric woven from an aramid fiber together, which is sold by Du Pont under the Trade Mark KEVLAR, and has been done for many years. It can be used in a flexible state or laminated in a more rigid configuration. The success of the product is attained by multiple layers of the semi-impregnable flexible structure. This material combines high penetration resistance with lightness and flexibility but until presently no one has endeavored to manufacture items like chairs of this material.

With respect to the above, before explaining at least one preferred embodiment of the Anti-ballistic Chairs herein in detail or in general, it is to be understood that the invention is not limited in its application to the details of construction and to the arrangement of the components or the steps set forth in the following description or illustrated in the drawings. The various apparatus and methods of the protective invention herein are capable of other embodiments and of being practiced and carried out in various ways, all of which will be obvious to those skilled in the art once the information herein is reviewed. Also, it is to be understood that the phraseology and terminology employed herein are for the purpose of description, and should not be regarded as limiting in any fashion. As such, those skilled in the art will appreciate that the conception upon which this disclosure is based may readily be utilized as a basis for designing other furniture type ballistic shields for carrying out the several purposes of the present disclosed device and method. It is important, therefore, that the embodiments, objects and claims herein, be regarded as including such equivalent construction and methodology insofar as they do not depart from the spirit and scope of the present invention.

SUMMARY

The principal advantage of Anti-ballistic Chairs is to supply conventionally appearing chairs that have the capability of offering anti-ballistic protection.

Another advantage of Anti-ballistic Chairs is to supply chairs that people can crouch behind in a defensive position.

Another advantage of Anti-ballistic Chairs is to supply chairs that can be relatively inexpensive to manufacture.

Another advantage is to supply Anti-ballistic Chairs fabricated of a variety of materials including multiple layers of soft fabric woven from an aramid fiber together, which is sold by Du Pont under the registered trademark KEVLAR® and will resist and absorb the impact of a bullet.

Another advantage is to supply Anti-ballistic Chairs fabricated of multiple layers of resin impregnated fabric of aramid fiber creating a hard anti-ballistic material that will resist and absorb the impact of a bullet.

Another advantage of the Anti-ballistic Chairs is that they may be manufactured in a variety of different styles including stacking chairs as a preferred embodiment and folding chairs as alternate embodiments.

Another advantage of Anti-ballistic folding chairs is that they can be easily transported and stacked.

Yet another advantage of Anti-ballistic folding chairs is that they can be held up by one or both hands in more mobile defensive positions.

A further advantage is to create Anti-ballistic Chairs that have been uniquely designed so that they may be manufactured in a factory that specializes in employing blind workers.

These together with other advantages of the Anti-ballistic Chairs, along with the various features of novelty, which characterize the design, are pointed out with particularity in the claims annexed to and forming a part of this disclosure. For a better understanding of the Anti-ballistic Chairs, their operating advantages and the specific objects attained by their uses, reference should be made to the accompanying drawings and descriptive matter in which there are illustrated preferred embodiments of the Anti-ballistic Chairs. There has thus been outlined, rather broadly, the more important features of the design in order that the detailed description thereof that follows may be better understood, and in order that the present contribution to the art may be better appreciated. There are additional features of the Anti-ballistic Chairs that will be described hereinafter and which will form the subject matter of the claims appended hereto.

In this respect, before explaining at least one embodiment of the Anti-ballistic Chairs in detail it is to be understood that the design is not limited in its application to the details of construction and to the arrangement of the components set forth in the following description or illustrated in the drawings. The Anti-ballistic Chairs are capable of other embodiments and of being practiced and carried out in various ways. In addition, it is to be understood that the phraseology and terminology employed herein are for the purpose of description and should not be regarded as limiting.

The preferred embodiment of the Anti-ballistic Chair will consist of a conventionally appearing stacking chair with padded seat cushion and back rest with a tubular framework with arm rests. The addition of a protective skirt section below the seat will extend to the floor level. The anti-ballistic core of the chair will consist of layers of fabric woven from an aramid fiber, which is sold by Du Pont under the Trade Mark KEVLAR® wrapped in two directions around the tubular members of the back rest, seat and skirt section.

Additionally, the anti-ballistic core portions of the Anti-Ballistic Chairs may be fabricated using not only Aramid fibers and KEVLAR® from DuPont, but also polyethylene fibers and GOLD SHIELD®, which is a KEVLAR® based material, and SPECTRA SHIELD®, which is polyethylene based material, both available commercially from Honeywell. GOLD SHIELD® and SPECTRA SHIELD® are high strength synthetic fibers impregnated in partially cured resin for use in ballistic material. Moreover, both of the Honeywell materials can be used as layered soft armor as well as hard armor when they are autoclaved or compression molded into anti-ballistic components for construction of the Anti-Ballistic Chairs. Other similar materials of like purpose and function are also anticipated by this disclosure.

The first alternate embodiment of the Anti-ballistic Chair will be a folding chair constructed of a tubular framework with hard anti-ballistic surfaces on the seat and lower skirt section with the back rest conventionally padded, having soft woven anti-ballistic fabric, or having the hard anti-ballistic surface. Two soft handles or two hard handles will be on either side of the seat so that when the chair is folded it may be held up in a defensive or offensive position.

The second alternate embodiment of the Anti-ballistic Chair will additionally be a folding chair constructed of a tubular framework that has the ability of having the hard anti-ballistic surface or the layers of fabric woven from an aramid fiber wrapped around the tubular members. Two soft handles or two hard handles will also be on either side of the seat of this chair so that when the chair is folded it may be held up in a defensive or offensive position.

While the description of the Anti-ballistic Chairs has been made herein with reference to particular embodiments thereof, a latitude of modifications, various changes and substitutions are intended in the foregoing disclosure, and it will be appreciated that in some instance some features of the design will be employed without a corresponding use of other features without departing from the scope of the invention as set forth.

BRIEF DESCRIPTION OF THE DRAWINGS

The accompanying drawings, which are incorporated in and form a part of this specification, illustrate embodiments of the Anti-ballistic Chairs and together with the description, serve to explain the principles of this application.

For a fuller understanding of the nature and advantages of the Anti-ballistic Chairs, reference should be made to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
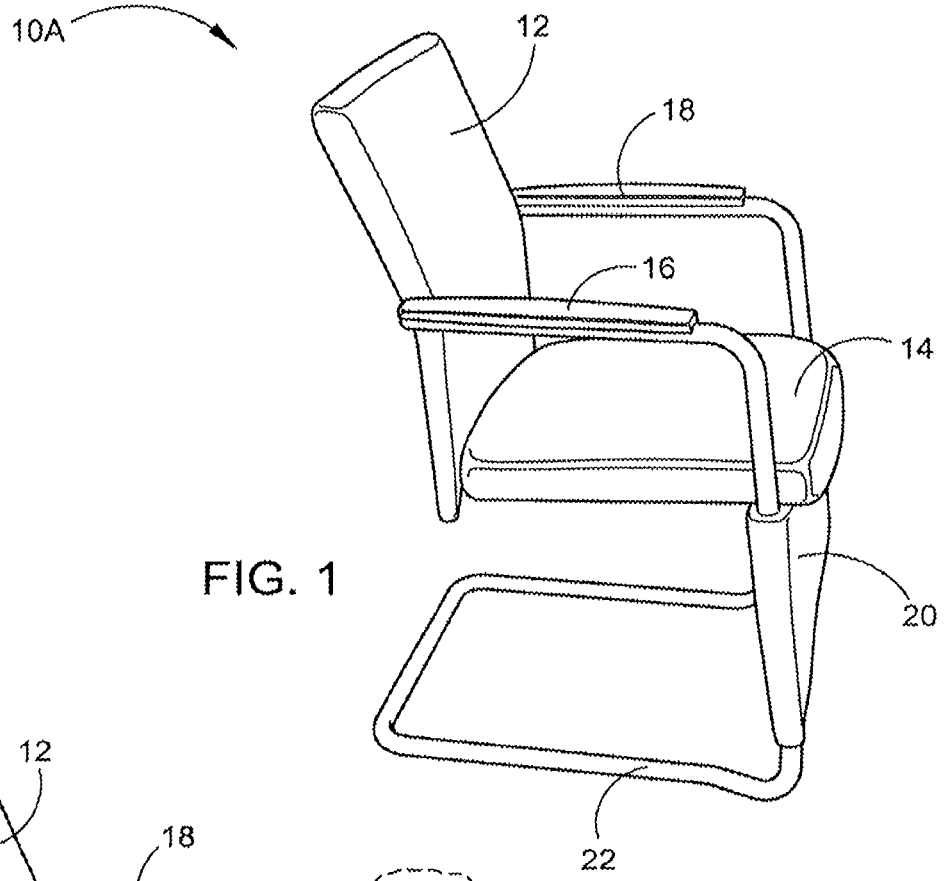
FIG. 1 depicts a perspective view of the Anti-ballistic Stacking Chair, constructed in accordance with the present invention.

Referring now to the drawings, wherein similar parts of the Anti-ballistic Chairs 10A, 10B and 10C are identified by like reference numerals, there is seen in FIG. 1, a perspective view of an Anti-ballistic Stacking Chair 10A consisting of a back support section 12 a seat 14, two arm rests 16 and 18, a front skirt section 20 and a supporting tubular frame 22.

Figure 2:
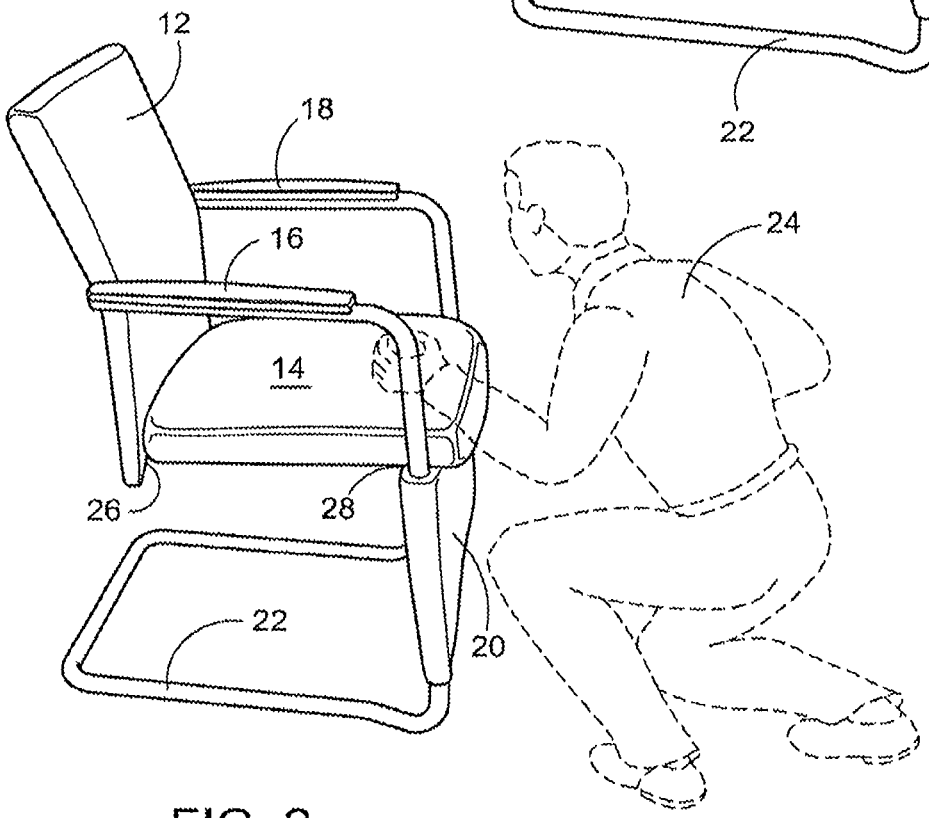
FIG. 2 depicts a perspective view of a person crouched down behind the Anti-ballistic Stacking Chair, constructed in accordance with the present invention.

FIG. 2 depicts a perspective view of a person 24 crouched down behind the Anti-ballistic Stacking Chair 10A illustrating the protection given by the back support section 12 and the front skirt section 20. The back support lower portion 26 extends below the seat 14 to protect the gap 28 created between the seat 14 and the skirt section 20. The seat 14, having the anti-ballistic capabilities will offer protection when the chair is tipped or held in other varying positions.

Figure 3:
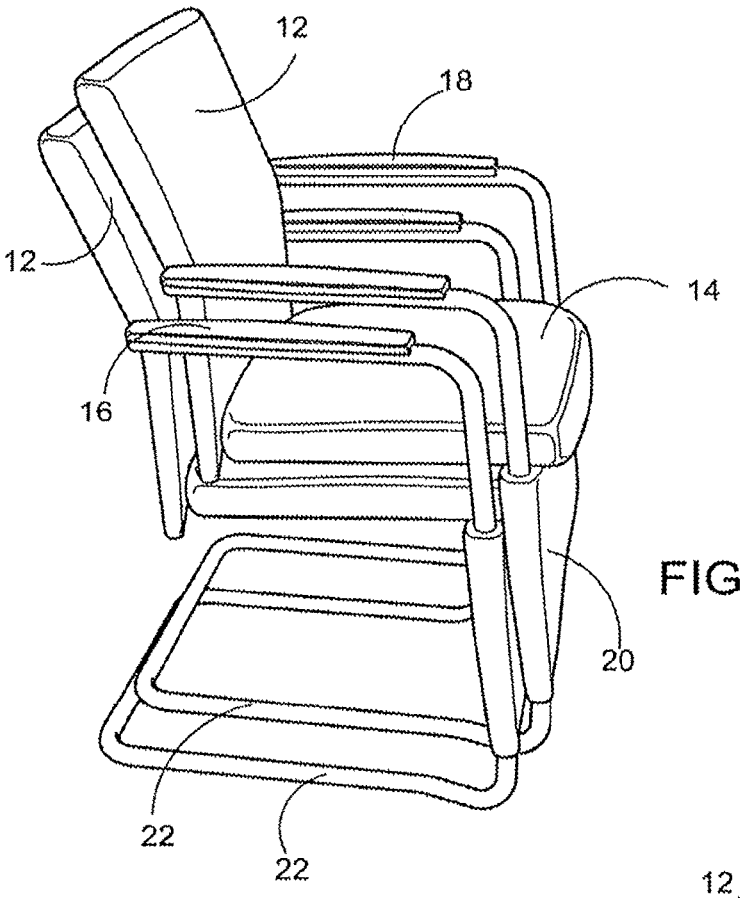
FIG. 3 depicts a perspective view of the Anti-ballistic Stacking Chair in the stacked configuration, constructed in accordance with the present invention.

FIG. 3 depicts a perspective view of the storage capability of the Anti-ballistic Stacking Chairs 10A in the stacked configuration where a number of these chairs can be placed one on top of the other.

Figure 4:
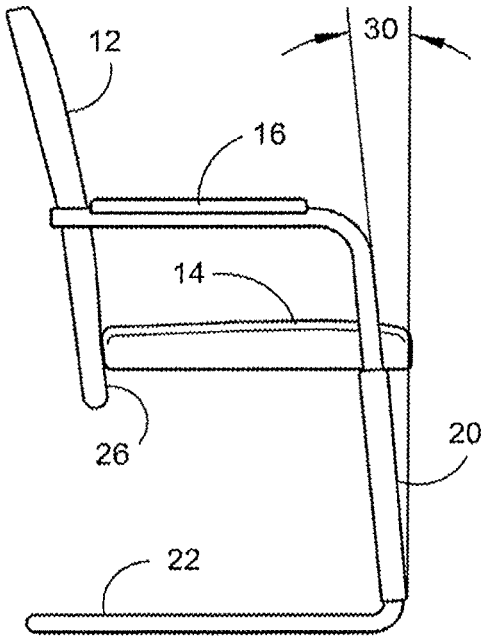
FIG. 4 depicts a side view of the Anti-ballistic Stacking Chair, constructed in accordance with the present invention.

FIG. 4 depicts a side view of the Anti-ballistic Stacking Chair 10A where the inclined angle 30 of the supporting tubular frame 22 and the similar inclination of the back support. section 12 allows a number of these chairs to be stacked on top of each other without their weight causing them to fall forward while adding flexible comfort for a person sitting in the chair. The supporting tubular frame 22 for the Anti-ballistic Stacking Chair 10A may be any of the following, being either hollow or solid: stamped, heat extruded, heat molded, round solid rod, oval solid rod, square solid rod, hollow round tube, hollow oval tube, hollow square tube, etc.

Figure 5:
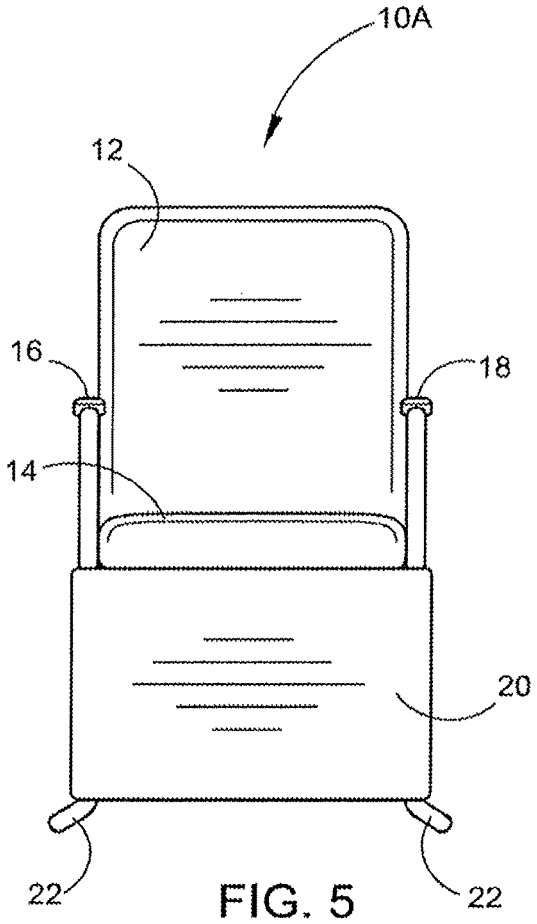
FIG. 5 depicts a front view of the Anti-ballistic Stacking Chair, constructed in accordance with the present invention.

FIG. 5 depicts a front view of the Anti-ballistic Stacking Chair 10A illustrating the complete anti-ballistic protection offered by the chair and the outward configuration of the lower portion of the supporting tubular frame 22 that allows that section of the chair to pass over the back support section 12, the seat 14 and the two arm rests 16 and 18 when the chairs are assembled into the stacked configuration.

Figure 6:
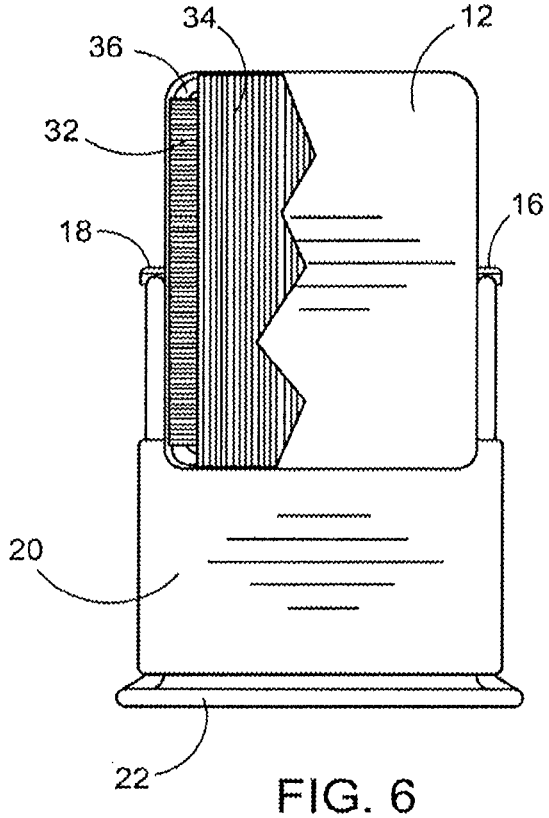
FIG. 6 depicts a rear view of the Anti-ballistic Stacking Chair exposing the layers of fabric woven from the aramid flexible fiber material through the decorative fabric covering on the back rest, constructed in accordance with the present invention. As illustrated the layers of the fabric woven from the aramid flexible fiber material may form at least a first sheet of fibers running in a first direction, and at least a second sheet of fibers funning in a second direction opposite the first direction.

FIG. 6 depicts a rear view of the Anti-ballistic Stacking Chair 10A with the back support section 12 having a portion of the conventional decorative outer covering and cushioning material removed exposing the horizontal layers of the aramid fiber protective material 32 and the vertical layers of the aramid fiber protective material 34 attached to the back support tubular metal frame work 36.

Figure 7:
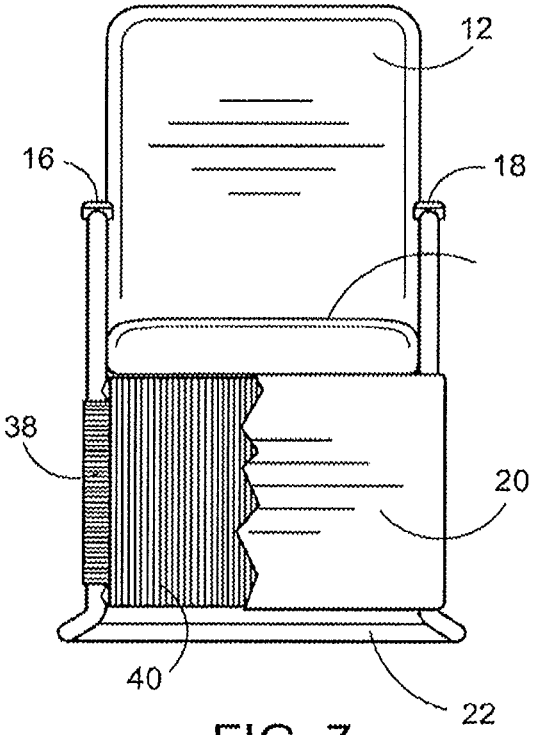
FIG. 7 depicts a front view of the Anti-ballistic Stacking Chair exposing the layers of fabric woven from the aramid flexible fiber material through the decorative fabric covering lower support member, constructed in accordance with the present invention.

FIG. 7 depicts a front view of the Anti-ballistic Stacking Chair 10A having a portion of the conventional decorative outer covering and cushioning material removed from the front skirt section 20 exposing the horizontal layers of the aramid fiber protective material 38 and the vertical layers of the aramid fiber protective material 40. The seat of the Anti-ballistic Stacking Chair 10A is made in a similar fashion with additional padding for comfort.

Figure 8:
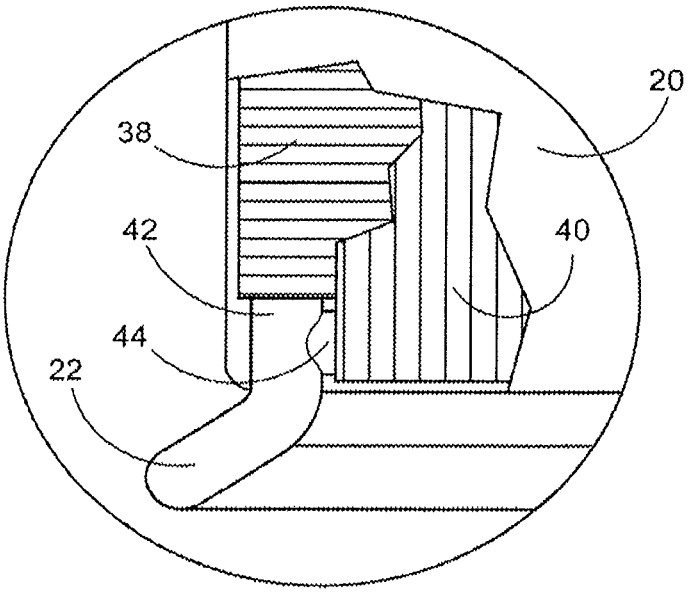
FIG. 8 depicts a detail drawing of the construction of one of the corners on the Anti-ballistic Stacking Chair lower support member indicating the overlapping layers of fabric woven from the aramid flexible fiber material, constructed in accordance with the present invention.

FIG. 8 depicts a detail drawing of the construction of one of the corners on the lower sections of the supporting tubular frame 22 of the Anti-ballistic Stacking Chair 10A further illustrating the overlapping layers of aramid fiber protective material 38 and 40 where aramid fiber protective material 38 wraps around the supporting tubular frame side bars 42 and the vertical layers of the aramid fiber protective 40 is shown wrapping around the lower cross bar 44. It must be fully understood at this time that different anti-ballistic materials can be used for the purpose of constructing the Anti-ballistic Stacking Chair 10A including a variety of soft materials along with hard surfaced resin impregnated laminated anti-ballistic materials some of which are sold by Du Pont under the registered trademark KEVLAR® and will still remain within the scope of this application.

Additionally, the anti-ballistic portions of the anti-ballistic stacking chairs may be fabricated using not only Aramid fibers and KEVLAR® from DuPont, but also polyethylene fibers and GOLD SHIELD®, which is a KEVLAR® based material, and SPECTRA SHIELD®, which is polyethylene based material, both available commercially from Honeywell. GOLD SHIELD® and SPECTRA SHIELD® are high strength synthetic fibers impregnated in partially cured resin for use in ballistic material. Moreover, both of the Honeywell materials can be used as layered soft armor as well as hard armor when they are autoclaved or compression molded into anti-ballistic components for construction of the anti-ballistic stacking chairs, as shown and described. Other similar materials of like purpose and function are also anticipated by this disclosure.

Figure 9:
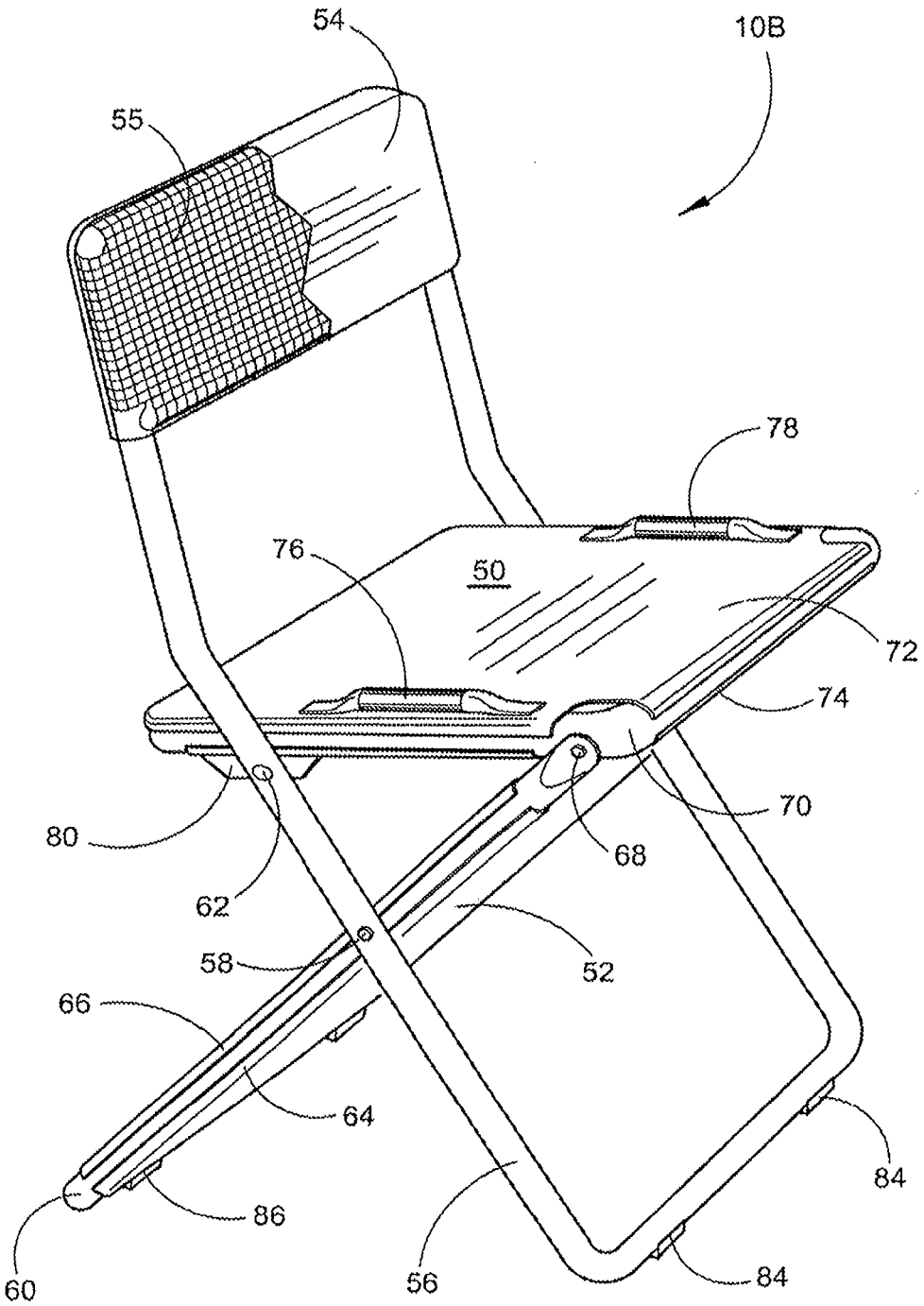
FIG. 9 depicts a perspective view of the first alternate embodiment of the Anti-ballistic Folding Chair with hard anti-ballistic surfaces, constructed in accordance with the present invention.

FIG. 9 depicts a perspective view of the first alternate embodiment of the Anti-ballistic Folding Chair 10B that has hard anti-ballistic surfaces on the seat 50 and lower skirt section 52. The back rest 54 has been illustrated as being a conventional padded back rest, but could be constructed in a similar fashion as the seat 50 and lower skirt section 52 and still remain within the scope of this application. The forward leg tubular frame member 56 pivots by the means of pivot pins 58 on either side through the rear leg tubular frame member 60. A seat support bar 62 is attached on either side of the forward leg tubular frame member 56 to support the rear of the seat 50 when it is in the unfolded configuration to be sat upon. The upper section of the forward leg tubular frame member 56 has the back rest 54 attached to it. The lower skirt section 52 has a front protective surface 64 and a rear protective surface 66 of the resin impregnated laminated anti-ballistic material. The rear leg tubular frame member 60 pivots at the front corners of the seat 50 by the means of a second set of pivot pins 68 inserted through the seat tubular frame 70. The seat 50 has a top surface 72 and a bottom surface 74 of the resin impregnated laminated anti-ballistic material with two soft handles 76 and 78. The seat 50 is held in place by the means of two seat securing brackets 80 and 82 (82 not shown here in FIG. 9, but shown in FIG. 12) that connect to the seat support bar 62. Two floor cushion pads 84 are located on the lower surface of the forward leg tubular frame member 56 and two additional floor cushion pads 86 are located on the lower surface of the rear leg tubular frame member 60. The tubular frame member 56 for the Anti-ballistic Folding Chair 10B may be any of the following, being either hollow or solid: stamped, heat extruded, heat molded, round solid rod, oval solid rod, square solid rod, hollow round tube, hollow oval tube, hollow square tube, etc.

Figure 10:
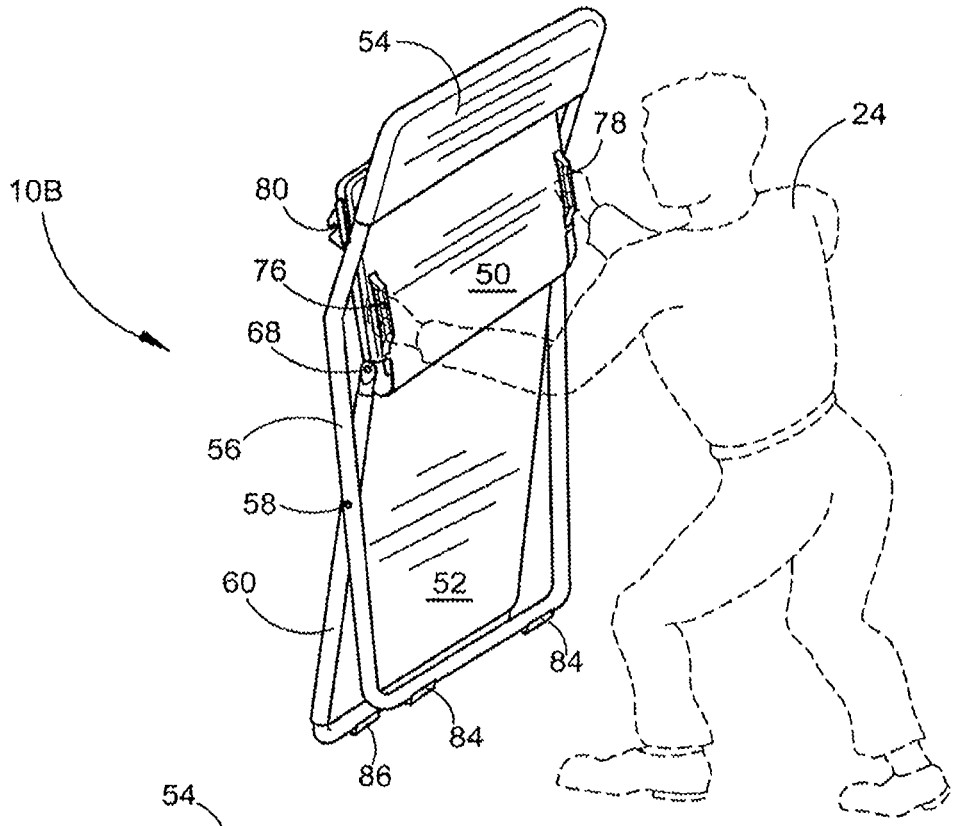
FIG. 10 depicts a perspective view of a person holding the Anti-ballistic Folding Chair in both their hands, constructed in accordance with the present invention.

FIG. 10 depicts a perspective view of a person 24 holding the soft handles 76 and 78 of the Anti-ballistic Folding Chair 10B with the hard anti-ballistic surface in both hands. In this position the Anti-ballistic Folding Chair 10B covers approximately ninety percent of the average persons 24 body.

Figure 11:
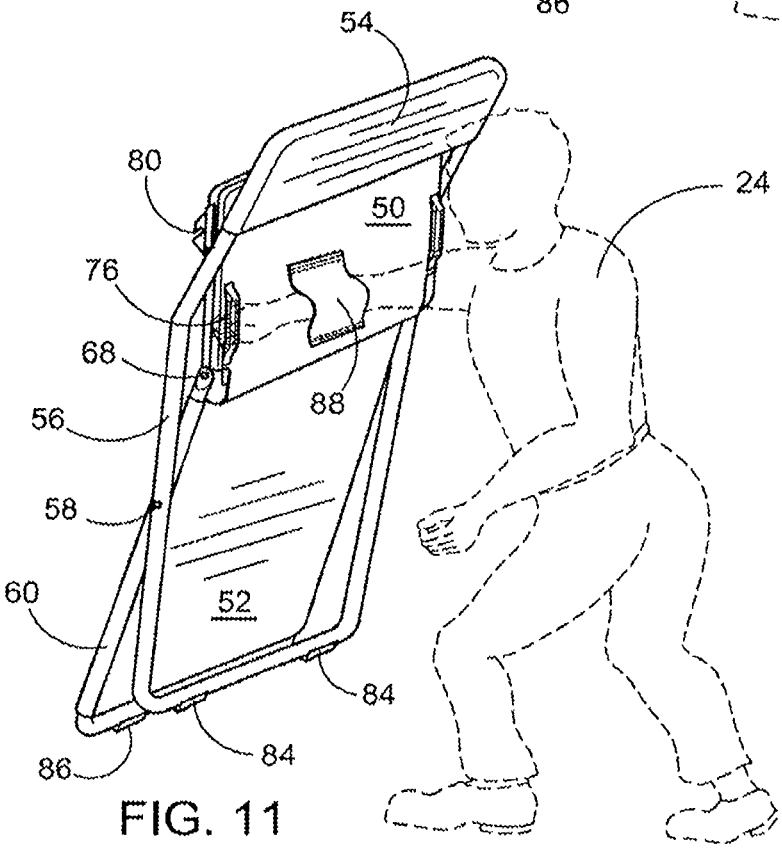
FIG. 11 depicts a perspective view of a person holding the Anti-ballistic Folding Chair in one hand with the other hand free, constructed in accordance with the present invention.

FIG. 11 depicts a perspective view of a person 24 holding the Anti-ballistic Folding Chair 10B with hard anti-ballistic surfaces with one hand through an optional wrist strap 88 and holding only one of the soft handles 76 leaving the other hand free for additional defensive or offensive movements.

Figures 12, 13, 14, 15:
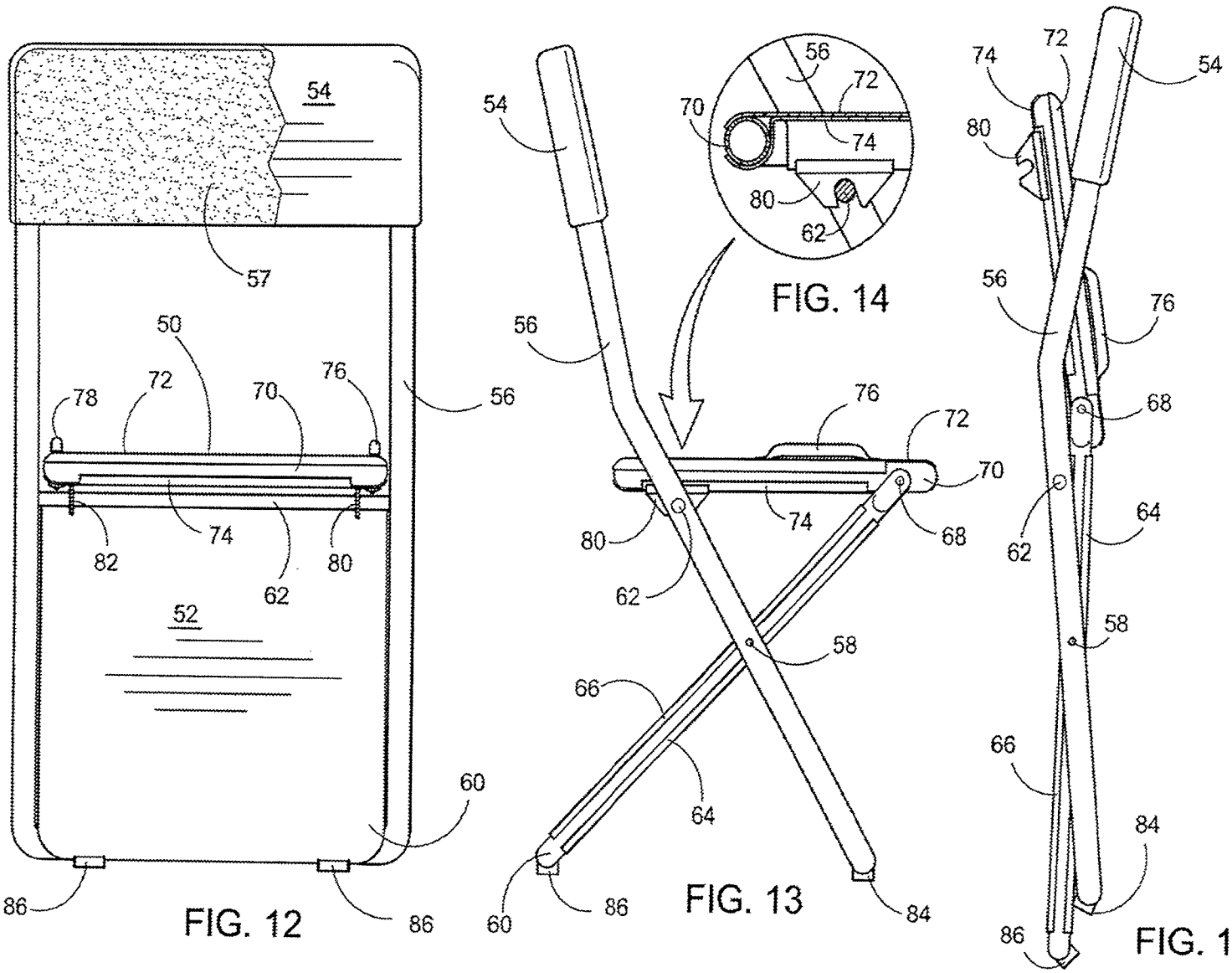
FIG. 12 depicts a back view of the Anti-ballistic Folding Chair, constructed in accordance with the present invention.
FIG. 13 depicts a side view of the Anti-ballistic Folding Chair, constructed in accordance with the present invention.
FIG. 14 depicts a cross section through the rear corner of the Anti-ballistic Folding Chair having hard anti-ballistic surfaces and exposing the seat securing bracket and seat support bar, constructed in accordance with the present invention.
FIG. 15 depicts a side view of the Anti-ballistic Folding Chair in the completely folded condition, constructed in accordance with the present invention.

FIG. 12 depicts a back view of the Anti-ballistic Folding Chair 10B with the hard anti-ballistic surfaces illustrating the locations of the seat securing brackets 80 and 82 as they are in place on the seat support bar 62 when the seat 50 is in the unfolded configuration to be sat upon.

FIG. 13 depicts a side view of the Anti-ballistic Folding Chair 10B with the hard anti-ballistic surfaces in the unfolded position.

FIG. 14 depicts a cross section through the rear corner of the Anti-ballistic Folding Chair 10B with hard anti-ballistic surfaces exposing the seat securing bracket 80 as a means of attachment to the seat support bar 62. This illustration clearly depicts the configuration of the seat top surface 72 and the seat bottom surface 74 where they wrap around the seat tubular frame 70 and the means of construction is repeated in a similar fashion with the skirt section front surface 64 and the skirt section rear surface 66.

FIG. 15 depicts a side view of the Anti-ballistic Folding Chair 10B in the completely folded condition where it can easily be stacked in a confined area.

Figure 16:
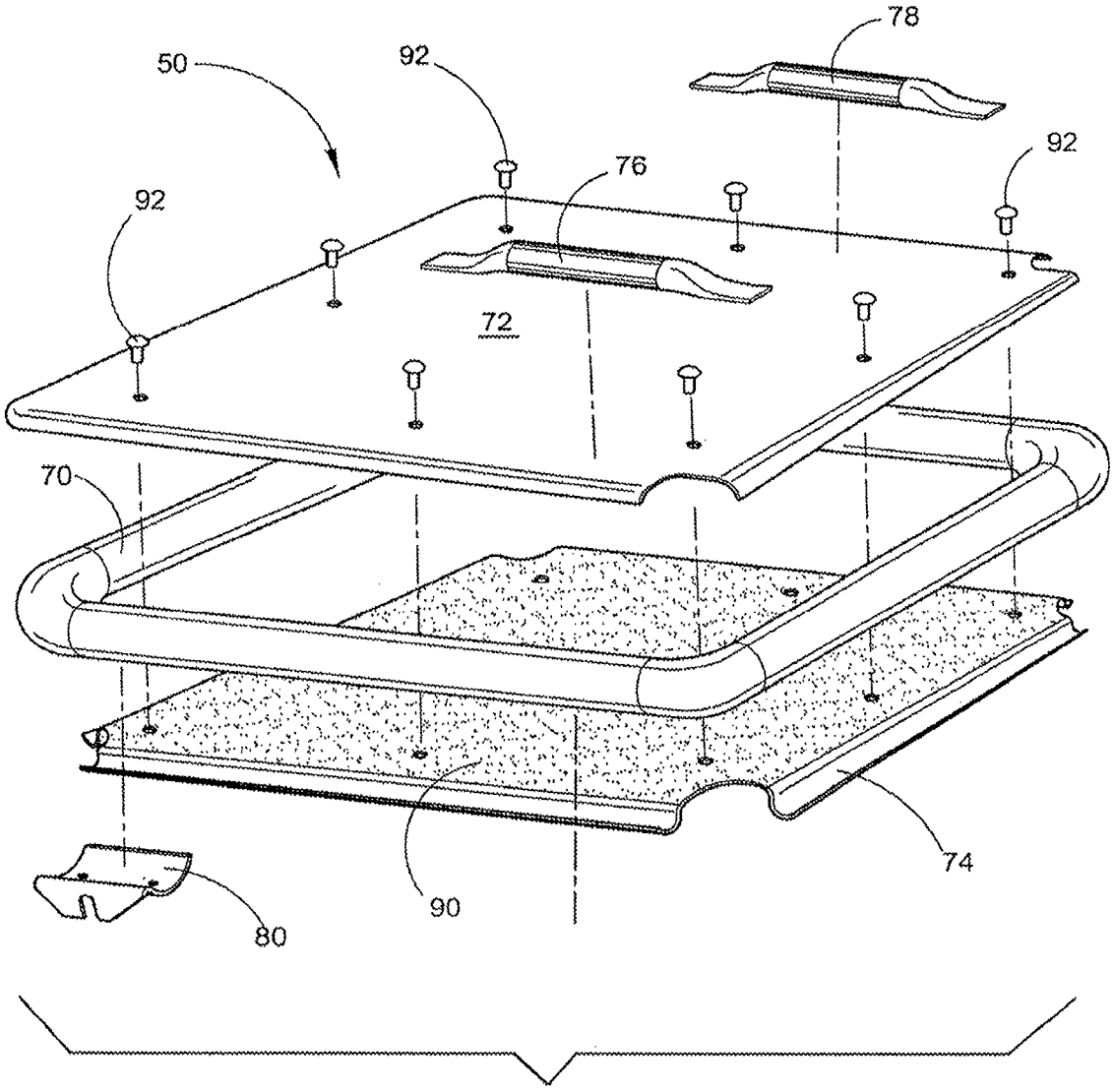
FIG. 16 depicts an exploded view of the seat portion of the Anti-ballistic Folding Chair with hard anti-ballistic surfaces illustrating top and bottom rigid aramid members attached together by the means of conventional fasteners with an additional bonding attachment, over the tubular frame work of the chair seat, constructed in accordance with the present invention.

FIG. 16 depicts an exploded view of the seat 50 of the Anti-ballistic Folding Chair 10B with hard anti-ballistic surfaces illustrating the seat top surface 72 with the soft handles 76 and 78 raised above the seat tubular frame 70. The seat bottom surface 74 conforms to the shape of the seat tubular frame 70 and is held by the means of a bonding agent 90 and multiple conventional fasteners 92.

Figure 17:
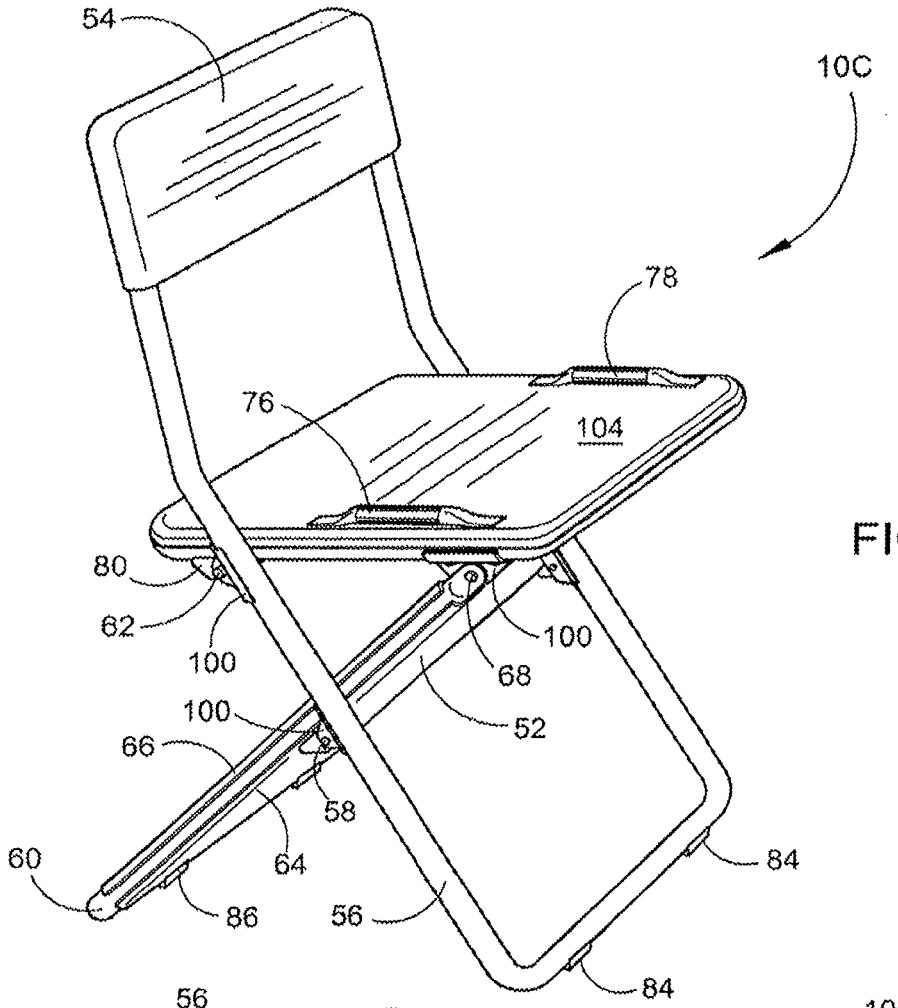
FIG. 17 depicts a perspective view of the second alternate embodiment of the Anti-ballistic Folding Chair that can be manufactured with either a hard or soft anti-ballistic surfaces, constructed in accordance with the present invention.

FIG. 17 depicts a perspective view of the second alternate embodiment of the Anti-ballistic Folding Chair 10C that can be manufactured with either hard or soft anti-ballistic surfaces. The basic configuration of this chair is similar to that of the Anti-ballistic Folding Chair 10B except that the pivot pins 58 and 68 go through pivot brackets 100 instead of going through the tubular frame of the chair. The seat securing bracket 80 is positioned over the seat support bar 62 which is mounted to the forward tubular frame member 56 by the means of two seat support bar mounting brackets 102. The rear leg tubular frame member 60 pivots on the forward leg tubular frame member 56 by the means of two pivot brackets 100 and pivot pins 58. The rear leg tubular frame member 60 pivots at the front corners of the seat 104 by the means of a second set of pivot pins 68 and a pair of pivot brackets 100. The pivot brackets 100 and seat support bar mounting brackets 102 have been designed to conform to the configuration of the tubular framework and increase the rigidity of the pivoting locations in addition to adding the capability of using both the hard surface and soft surface anti-ballistic surfaces to this embodiment. Two floor cushion pads 84 are located on the lower surface of the forward leg frame member 56 and two additional floor cushion pads 86 are located on the lower surface of the rear leg tubular frame member 60. The tubular frame member 56 for the Anti-ballistic Folding Chair 10C may be any of the following, being either hollow or solid: stamped, heat extruded, heat molded, round solid rod, oval solid rod, square solid rod, hollow round tube, hollow oval tube, hollow square tube, etc.

Figure 18:
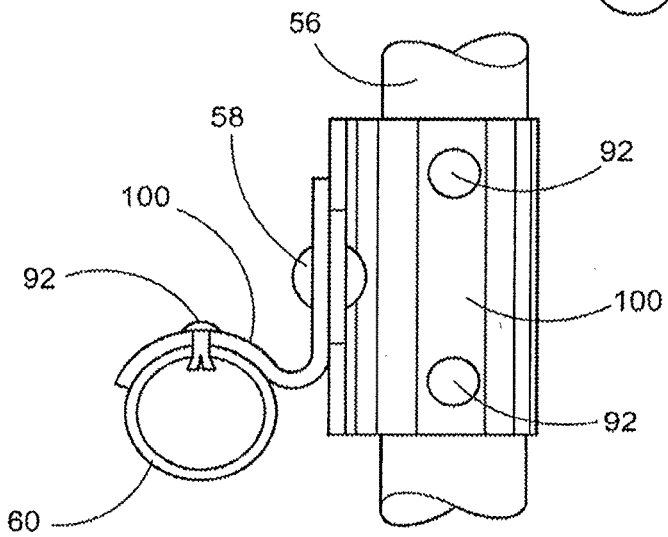
FIG. 18 depicts a section of the Anti-ballistic Folding Chair frame with two of the pivot brackets connected by the means of a pivot pin that conform to the shape of the tubular framework, constructed in accordance with the present invention.

FIG. 18 depicts a typical frame section of the Anti-ballistic Folding Chair 10C with two of the pivot brackets 100 that conform to the shape of the tubular framework are held in position by conventional fasteners 92 and pivot by the means of a pivot pin 58.

Figure 19:
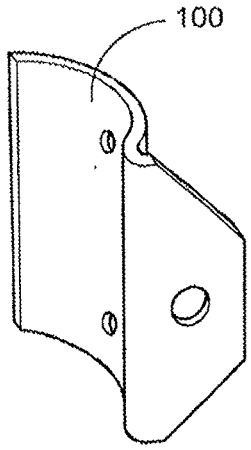
FIG. 19 depicts a perspective view of one of the pivot brackets of the Anti-ballistic Folding Chair, constructed in accordance with the present invention.

FIG. 19 depicts a perspective view of one of the pivot brackets 100 of the Anti-ballistic Folding Chair 10C. These chairs have the opportunity of being manufactured by companies who employ blind workers and the brackets have a curved configuration to fit over the tubular framework of the chairs and be easily located into their positions.

Figure 20:
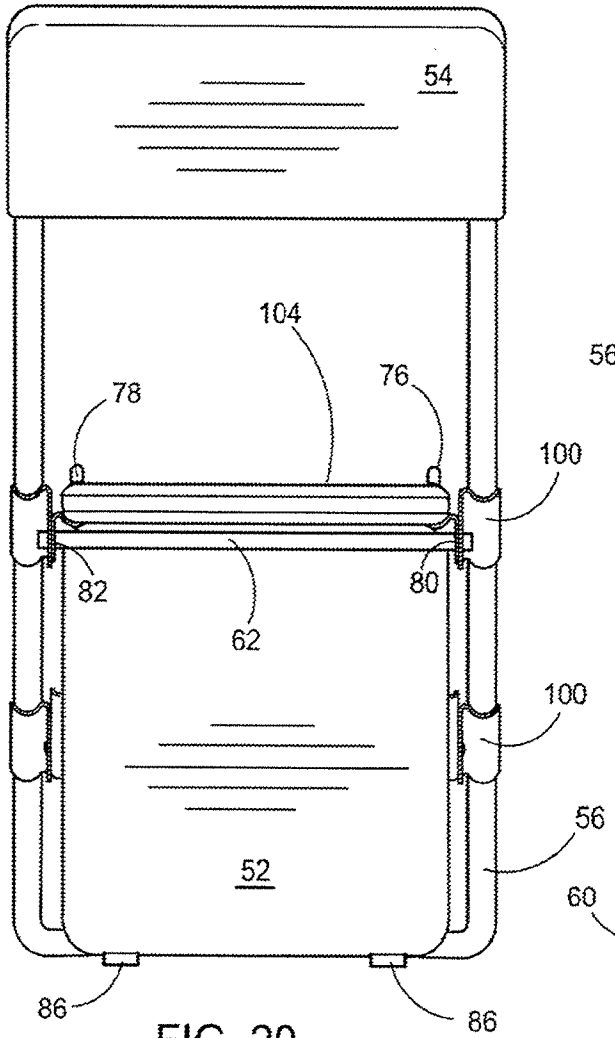
FIG. 20 depicts a rear view of the second alternate embodiment of the Anti-ballistic Folding Chair that can be manufactured with either a hard or soft anti-ballistic surface, constructed in accordance with the present invention.

FIG. 20 depicts a rear view of the second alternate embodiment of the Anti-ballistic Folding Chair 10C that can be manufactured with either a hard or soft anti-ballistic surface.

Figure 21:
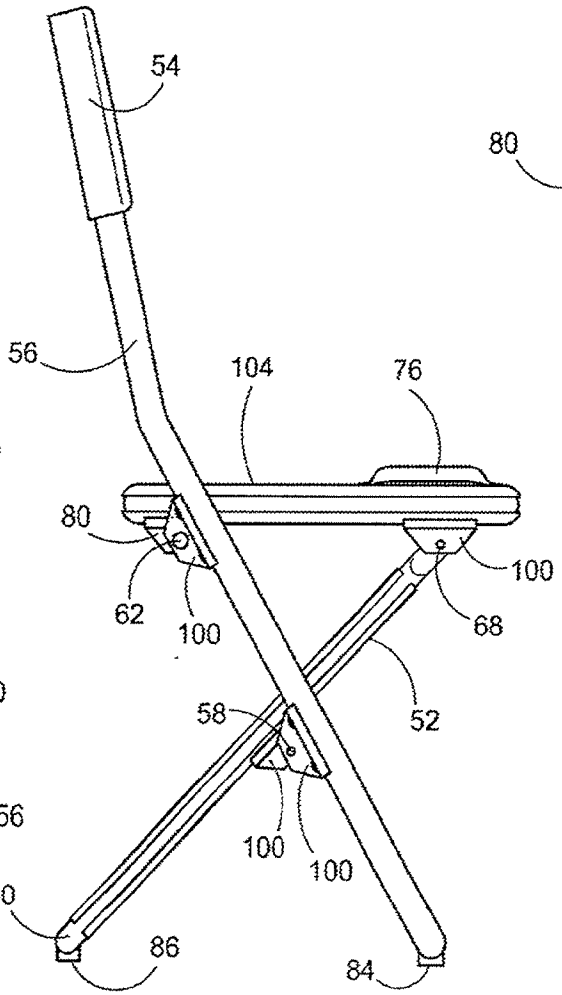
FIG. 21 depicts a side view of the second alternate embodiment of the Anti-ballistic Folding Chair, constructed in accordance with the present invention.

FIG. 21 depicts a side view of the second alternate embodiment of an Anti-ballistic Folding Chair 10C that can be manufactured with either a hard or soft anti-ballistic surface. This view illustrates the offset mounting positions required of the pivot brackets 100.

Figure 22:
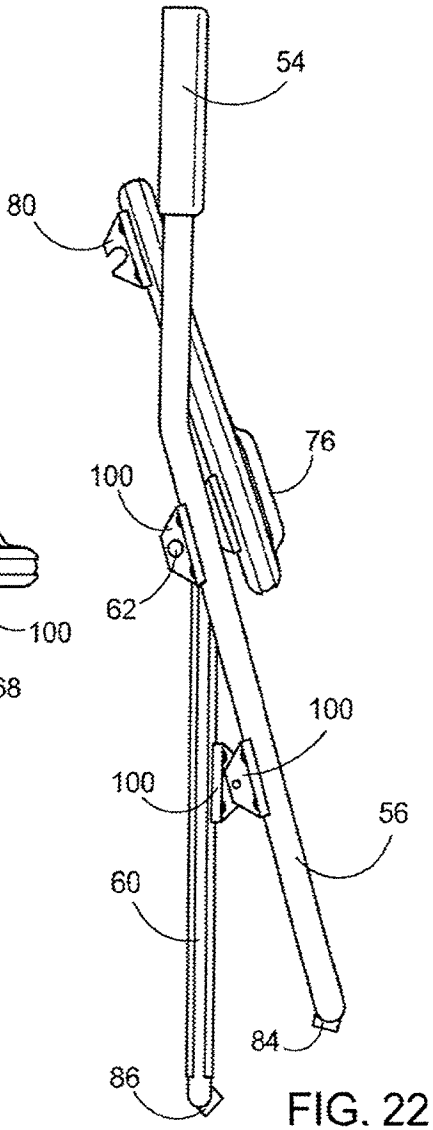
FIG. 22 depicts a side view of the second alternate embodiment of an Anti-ballistic Folding Chair in the completely folded position, constructed in accordance with the present invention.

FIG. 22 depicts a side view of the second alternate embodiment of an Anti-ballistic Folding Chair 10C that can be manufactured with either a hard or soft anti-ballistic surface in the completely folded position.

Figure 23:
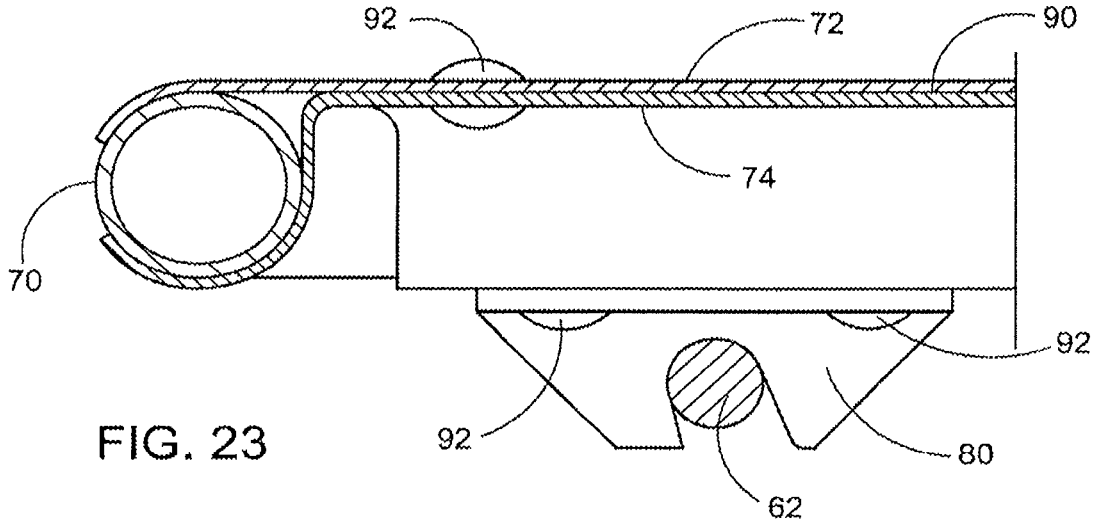
FIG. 23 depicts a cross section through a segment of the frame of the Anti-ballistic Folding Chairs illustrating two rigid aramid members attached together on the upper surface, over the tubular frame work of the chair, constructed in accordance with the present invention.

FIG. 23 depicts a cross section through a segment of the frame of the Anti-ballistic Folding Chairs 10B and 10C illustrating seat top surface 72 and the seat bottom surface 74 of rigid aramid materials attached together by the means of conventional fasteners 92 and a bonding agent 90, over the seat tubular frame 70 of the chair.

Figure 24:
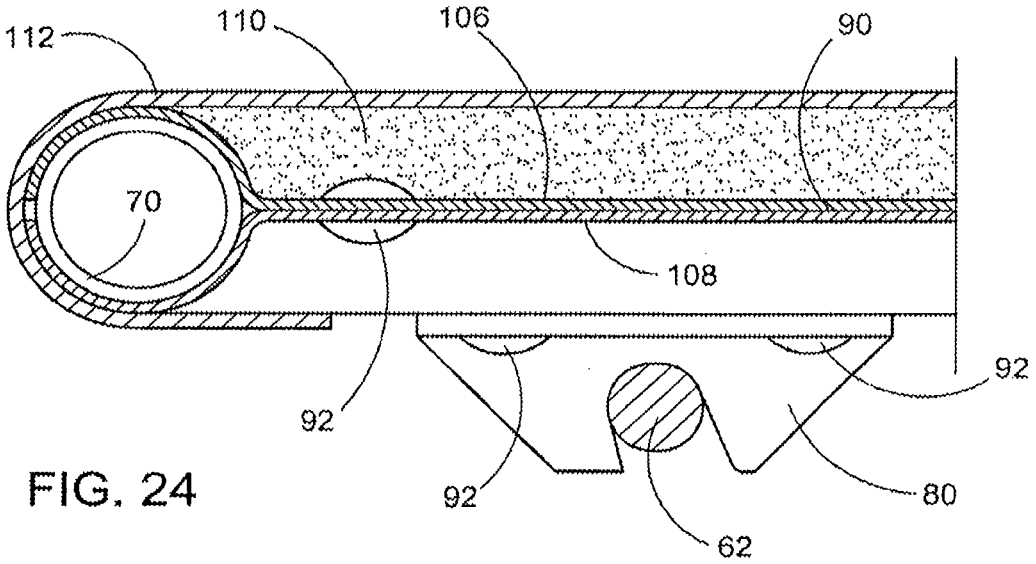
FIG. 24 depicts a cross section through a segment of the frame of the Anti-ballistic Folding Chairs illustrating two rigid aramid members attached together centrally located in the tubular frame work with a foam cushion and decorative fabric covering, constructed in accordance with the present invention.

FIG. 24 depicts a cross section through a segment of the frame of the Anti-ballistic Folding Chairs 10B and 10C illustrating two rigid aramid members with an upper surface 106 and a lower surface 108 attached together by the means of conventional fasteners 92 and a bonding agent 90, centrally located in the seat tubular frame 70 with a foam cushion 110 and decorative fabric covering 112.

Figure 25:
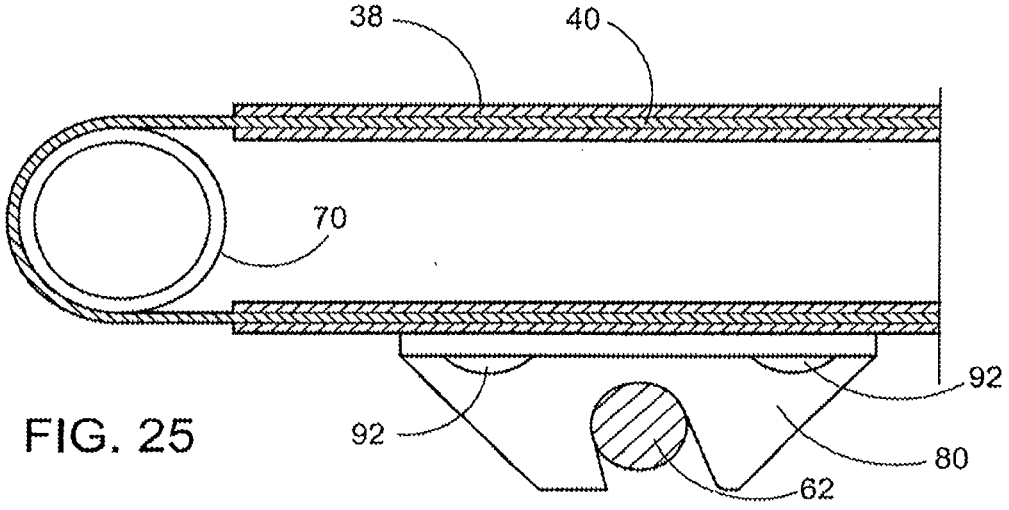
FIG. 25 depicts a cross section through a segment of the frame of the Anti-ballistic Folding Chair illustrating layers of flexible fabric woven from the aramid fiber wrapped around the frame work of the chair, constructed in accordance with the present invention.

FIG. 25 depicts a cross section through a segment of the frame of the Anti-ballistic Stacking Chair 10A and the Anti-ballistic Folding Chair 10C illustrating layers of the aramid fiber protective material 114 and 116 woven from the flexible aramid fiber wrapped around the frame 70 of the chairs.

Likewise, as previously described for the stacking chairs, the anti-ballistic portions of the anti-ballistic folding chairs may be fabricated using not only Aramid fibers and KEVLAR® from DuPont, but also polyethylene fibers and GOLD SHIELD®, which is a KEVLAR® based material, and SPECTRA SHIELD®, which is polyethylene based material, both available commercially from Honeywell. GOLD SHIELD® and SPECTRA SHIELD® are high strength synthetic fibers impregnated in partially cured resin for use in ballistic material. Moreover, both of the Honeywell materials can be used as layered soft armor as well as hard armor when they are autoclaved or compression molded into anti-ballistic components for construction of the anti-ballistic folding chairs, as shown and described. Other similar materials of like purpose and function are also anticipated by this disclosure.

The Anti-ballistic Chairs 10A, 10B and 10C shown in the drawings and described in detail herein disclose arrangements of elements of particular constriction and configuration for illustrating preferred embodiments of structure and method of operation of the present application. It is to be understood, however, that elements of different construction and configuration and other arrangements Anti-ballistic Chairs 10A, 10B and 10C in accordance with the spirit of this thereof, other than those illustrated and described may be employed for providing disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office, international patent offices, and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed:

1. A piece of anti-ballistic furniture comprising:

a frame;

a back portion attached to the frame, the back portion comprising an anti-ballistic back core, wherein the anti-ballistic back core comprises, a first sheet comprising a first plurality of high-strength synthetic fibers wrapped around the frame in a first direction, and a second sheet layered and overlapping with the first sheet, the second sheet comprising a second plurality of high strength synthetic fibers, each of the second plurality of high strength synthetic fibers being wrapped around each of the first plurality of high-strength synthetic fibers and the frame in a second direction, different from the first direction, wherein the first sheet extends across substantially the entire surface of the back portion in a direction orthogonal to the first direction of the first plurality of high-strength synthetic fibers, and wherein the second sheet extends across substantially the entire surface of the back portion in a direction orthogonal to the second direction of the second plurality of high-strength synthetic fibers; and a seat portion attached to the frame.

2. The anti-ballistic furniture, according to claim 1, wherein said back portion includes a cushion portion located on the outside of said anti-ballistic back core.

3. The anti-ballistic furniture, according to claim 1, wherein said anti-ballistic back core is comprised of layered soft armor.

4. The anti-ballistic furniture, according to claim 1, wherein said anti-ballistic back core is comprised of molded hard armor.

5. The anti-ballistic furniture, according to claim 1, wherein said anti-ballistic back core comprises proprietary light weight high strength synthetic fiber materials which are formed from aramid-based material.

6. The anti-ballistic furniture, according to claim 1, wherein said anti-ballistic back core comprises proprietary light weight high strength synthetic fiber materials which are formed from polyethylene-based material.

7. The anti-ballistic furniture according to claim 1, wherein the seat portion comprising an anti-ballistic seat core, wherein the anti-ballistic seat core comprises a first sheet of high-strength synthetic fibers wrapped around the frame in a first direction, and a second sheet layered with the first sheet, the second sheet comprising high strength synthetic fibers wrapped around the frame in a second direction, different from the first direction.

8. A piece of anti-ballistic furniture comprising:

a frame;

a back portion attached to the frame; and a seat portion attached to the frame, the seat portion comprising an anti-ballistic seat core, wherein the anti-ballistic seat core comprises a first layer comprising a first plurality of high-strength synthetic fibers wrapped around the frame in a first direction, and a second layer a second plurality of high strength synthetic fibers overlapping the first layer, each of the second plurality of high strength synthetic fibers being wrapped around each of the first plurality of high-strength synthetic fibers and the frame in a second direction, different from the first direction, wherein the first layer extends across substantially an entire surface of the seat portion in a direction orthogonal to the first direction of the first plurality of high-strength synthetic fibers, and wherein the second layer extends across substantially an entire surface of the seat portion in a second direction orthogonal to the second direction of the second plurality of high-strength synthetic fibers.

9. The anti-ballistic furniture, according to claim 8, wherein said seat portion includes a cushion portion located on the outside of said anti-ballistic seat core.

10. The anti-ballistic furniture, according to claim 8, wherein said anti-ballistic seat core is comprised of layered soft armor.

11. The anti-ballistic furniture, according to claim 8, wherein said anti-ballistic a seat portion core is comprised of molded hard armor.

12. The anti-ballistic furniture, according to claim 8, wherein said anti-ballistic seat core comprises proprietary light weight high strength synthetic fiber materials which are formed from aramid-based material.

13. The anti-ballistic furniture, according to claim 8, wherein said anti-ballistic seat core comprises proprietary light weight high strength synthetic fiber materials which are formed from polyethylene-based material.

14. The anti-ballistic furniture according to claim 8, wherein the back portion comprises an anti-ballistic back core, wherein the anti-ballistic back core comprises, a first sheet of high-strength synthetic fibers wrapped around the frame in a third direction, and a second sheet layered with the first sheet, the second sheet comprising high strength synthetic fibers wrapped around the frame in a fourth direction, different from the first direction.

15. An anti-ballistic furniture portion configured for a piece of furniture frame, the anti-ballistic portion comprising:

a frame;

a first sheet comprising a first plurality of high-strength synthetic fibers wrapped around the frame in a first direction, and a second sheet layered and overlapping with the first sheet, the second sheet comprising a second plurality of high strength synthetic fibers each of the second plurality of high strength synthetic fibers being wrapped around each of the first plurality of high-strength synthetic fibers and the frame in a second direction, different from the first direction, wherein the first sheet extends across substantially an entire surface of the anti-ballistic furniture portion in a direction orthogonal to the first direction of the first plurality of high-strength synthetic fibers, and wherein the second sheet extends across substantially an entire surface of the anti-ballistic furniture portion in a direction orthogonal to the second direction of the second plurality of high-strength synthetic fibers.

16. The anti-ballistic furniture portion, according to claim 15, further comprising a cushion portion located on the outside of said anti-ballistic furniture portion.

17. The anti-ballistic furniture portion, according to claim 15, wherein said anti-ballistic furniture portion is comprised of layered soft armor.

18. The anti-ballistic furniture portion, according to claim 15, wherein said anti-ballistic furniture portion is comprised of molded hard armor.

19. The anti-ballistic furniture portion, according to claim 15, wherein said anti-ballistic furniture portion comprises proprietary light weight high strength synthetic fiber materials which are formed from aramid-based material.

20. The anti-ballistic furniture portion, according to claim 15, wherein said anti-ballistic furniture portion comprises proprietary light weight high strength synthetic fiber materials which are formed from polyethylene-based material.

* * * * *